US012575702B2

(12) United States Patent
Fernandez Diez

(10) Patent No.: US 12,575,702 B2
(45) Date of Patent: Mar. 17, 2026

(54) PRODUCT DISPENSER IN GEL OR CREAM FORM

(71) Applicant: LANDE, S.A., Getafe (ES)

(72) Inventor: Javier Fernandez Diez, Getafe (ES)

(73) Assignee: LANDE, S.A., Getafe (ES)

( * ) Notice: Subject to any disclaimer, the term of this patent is extended or adjusted under 35 U.S.C. 154(b) by 179 days.

(21) Appl. No.: 18/680,534

(22) Filed: May 31, 2024

(65) Prior Publication Data

US 2024/0398174 A1 Dec. 5, 2024

(30) Foreign Application Priority Data

Jun. 1, 2023 (ES) ..... P202330440
May 21, 2024 (ES) ..... U202430932

(51) Int. Cl.
*A47K 5/12* (2006.01)

(52) U.S. Cl.
CPC ..... *A47K 5/1205* (2013.01); *A47K 2201/02* (2013.01)

(58) Field of Classification Search
CPC .... A47K 1/09; A47K 5/1205; A47K 2201/02; A47K 2201/025
USPC .. 222/153.01, 153.03, 160, 173, 180, 181.2, 222/181.3, 183, 184, 570
See application file for complete search history.

(56) References Cited

U.S. PATENT DOCUMENTS 6,820,770 B2 * 11/2004 Makino ..... A47K 5/12 248/154
2005/0133526 A1 6/2005 Lewis et al.
2012/0199609 A1 * 8/2012 Schwenkenberg ..... A47K 5/122 222/181.3
2013/0092708 A1 * 4/2013 Geiberger ..... A47K 5/1209 222/181.3
2016/0288151 A1 * 10/2016 Schultz ..... F16M 13/02
2021/0076881 A1 3/2021 Li et al.
2021/0321830 A1 * 10/2021 Kilic ..... A47K 5/1205
2022/0000320 A1 * 1/2022 Marinelli ..... A47K 5/12
2024/0188763 A1 * 6/2024 Schmidt ..... A47K 5/1205
2024/0341542 A1 * 10/2024 Park ..... A47K 5/12

FOREIGN PATENT DOCUMENTS

CN 217524880 U 10/2022
ES 1287638 U 3/2022
KR 102394043 B1 5/2022

OTHER PUBLICATIONS

Search Report from ES202330440; 9 pages; Nov. 10, 2023; Ana Maria Redondo Minguez.

* cited by examiner

*Primary Examiner* — Luan K Bui

(74) *Attorney, Agent, or Firm* — Dicke, Billig & Czaja, PLLC

(57) ABSTRACT

Product dispenser in gel or cream form comprising a product container with a window, a support for the container, and means of temporary coupling between the container and the support. The means of temporary coupling between the container and the support include a first locking mechanism that prevents the container from being removed from the support. In addition, a second mechanism prevents the window from being viewed, without the need for physical separation between the container and the support.

2 Claims, 7 Drawing Sheets

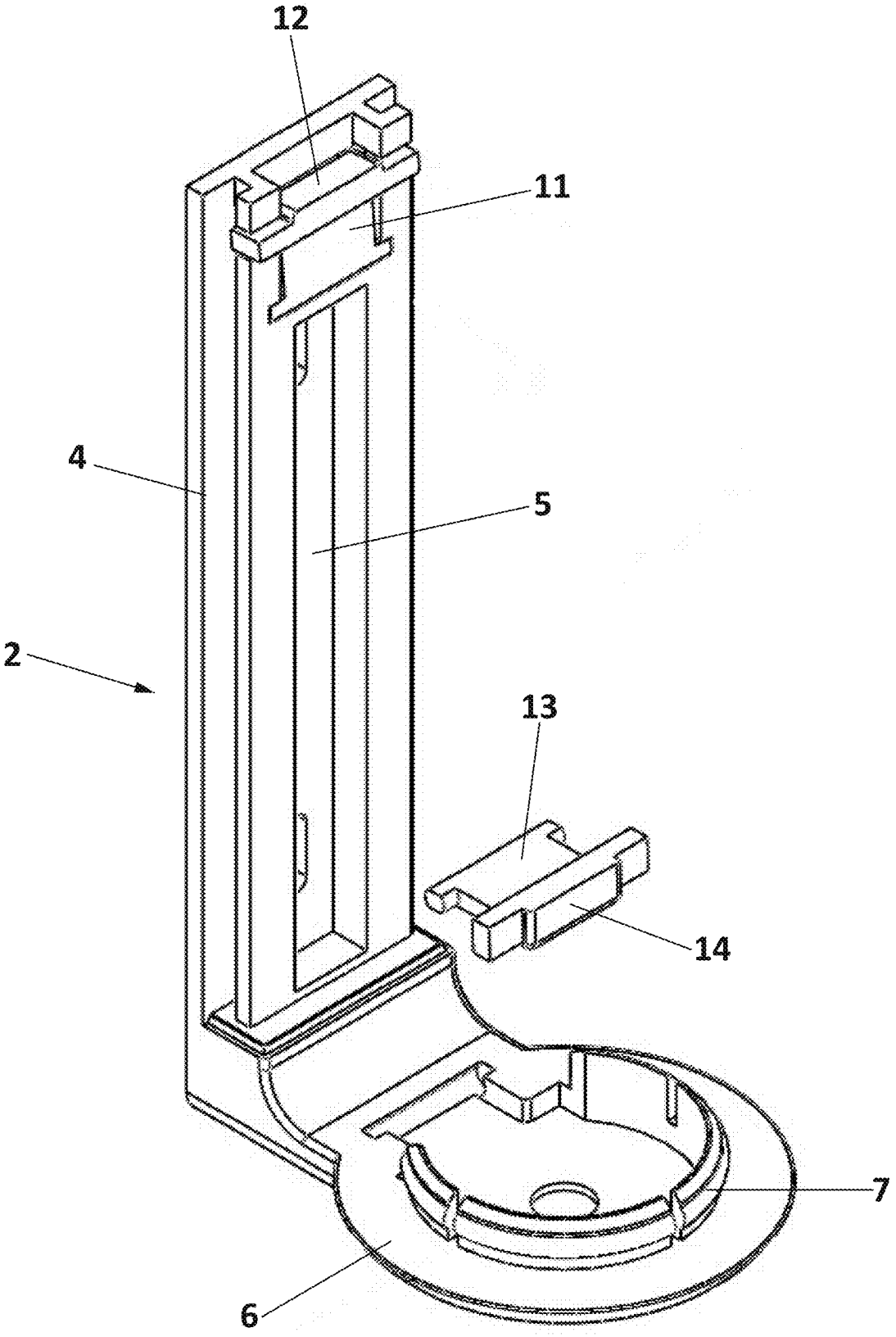
FIG. 3.1

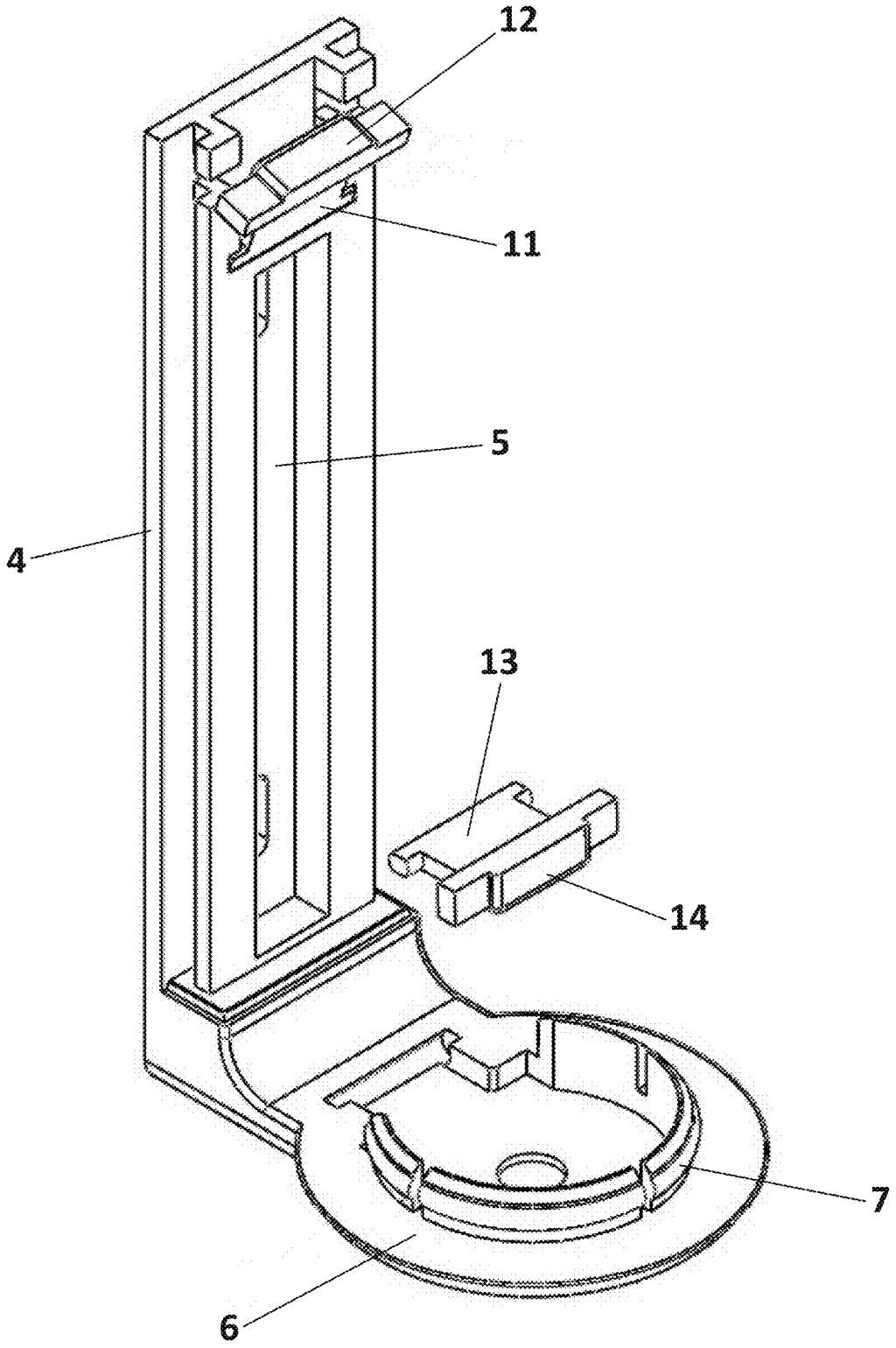
FIG. 3.2

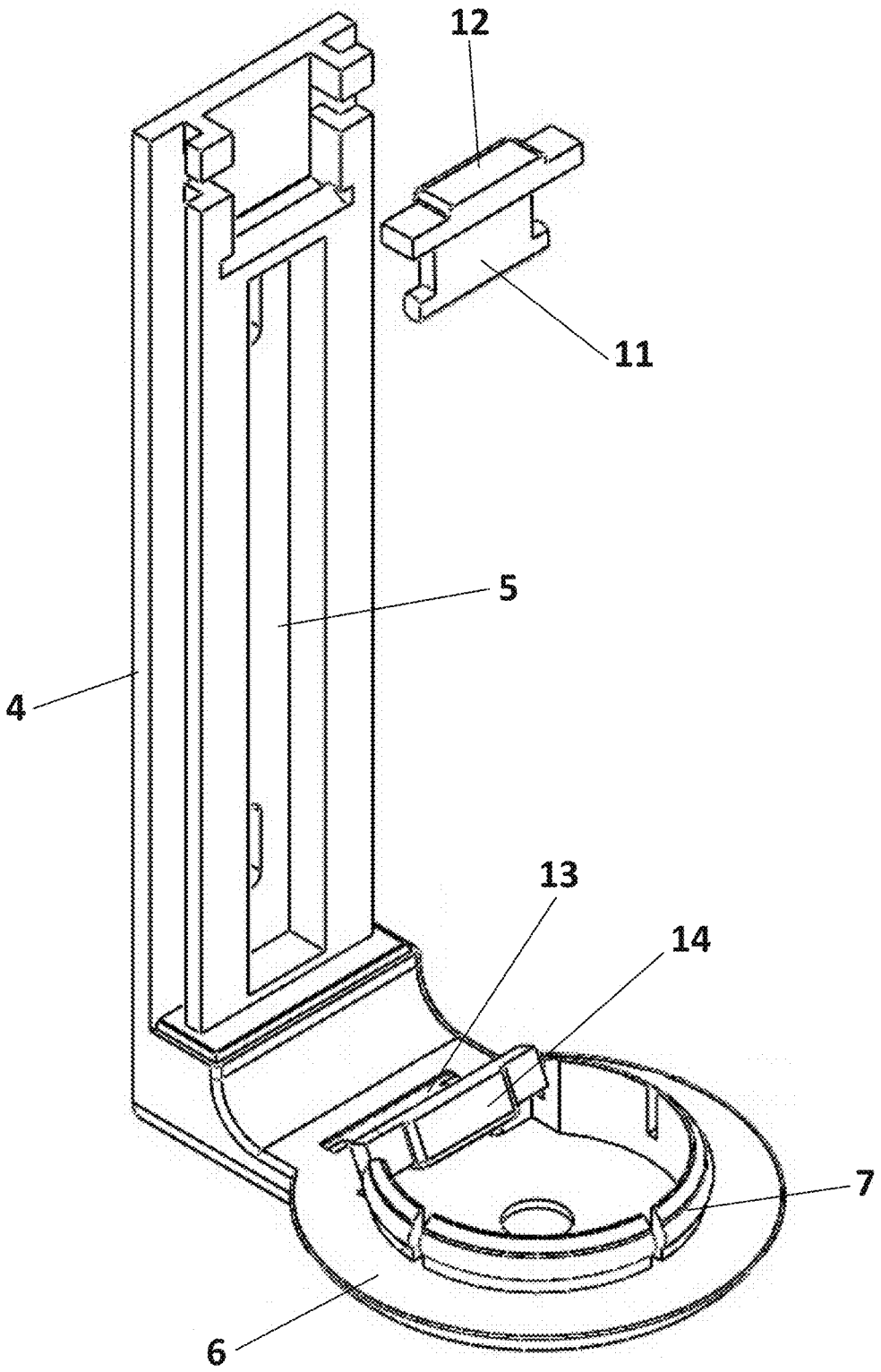
FIG. 4.1

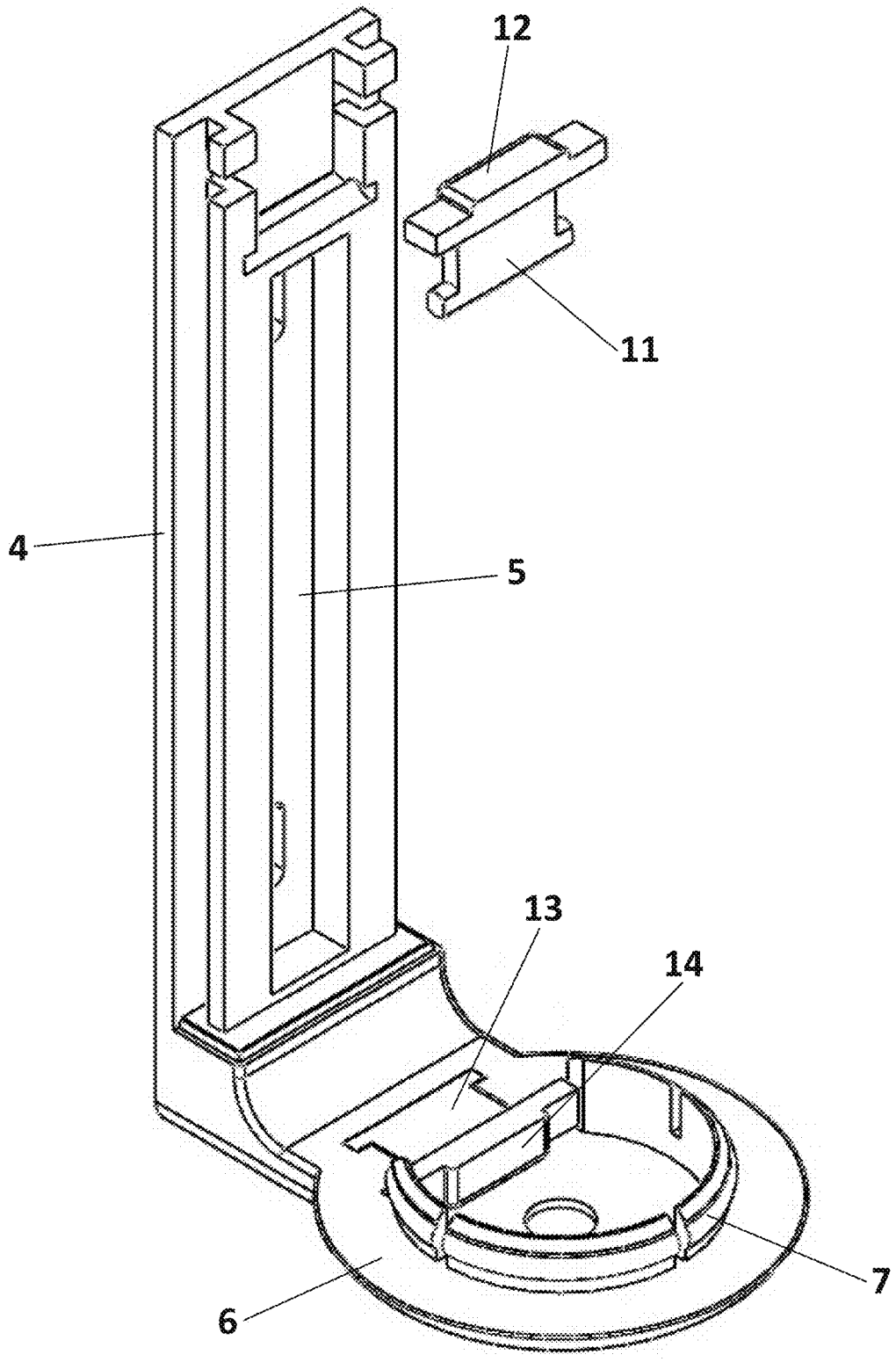
FIG. 4.2

PRODUCT DISPENSER IN GEL OR CREAM FORM

TECHNICAL FIELD

The present invention falls within the technical field of product dispensers in the form of gel or cream, in particular those comprising a container for containing the product, which can be exchanged, a support for the product and means for fixing said support to a wall.

BACKGROUND

Nowadays, in all places where products in the form of gel or cream are used, such as bathrooms and even kitchens, the form of presentation of these products is by means of product dispensers, as it is a very practical and convenient utensil to use that allows a controlled quantity of product to be dispensed and its containment to be adequate.

In hotels or places of public use, these dispensers are fixed to the wall to prevent theft. Thus, the dispenser has a container that is responsible for the containment of the product and a support for this tank, which has means of attachment to the wall.

As the support is physically fixed to the wall, the container is easily removable, so that the product can be removed by anyone who wishes to do so.

To avoid these situations, these dispensers have been refined by finding a way to anchor the container to the support so that it cannot be easily removed by a third party. The problem with these anchors is that they complicate the work of the cleaners, who are usually in charge of refilling these tanks.

In practice, these anchorages have proved to be difficult to unlock, as they usually require a key or element to be inserted into a hole or slot to remove the inner lock, but these holes or slots are hidden or in positions that are difficult to see at first glance, which in turn creates difficulties for the insertion of the unlocking element or key. Moreover, on many occasions, to avoid undesired extraction of the tank, it is completely attached to the support and the worker who tries to refill the container must do so without being able to remove it from the dispenser, sometimes in complicated positions that can cause the product to spill or fall out.

On the other hand, it must be borne in mind that these workers have just enough time to clean each room, and, in each room, there may be one or more dispensers, for the washbasin and shower, so that these means of blocking the tank, although necessary, are creating a problem.

As the container is usually opaque and does not show the contents inside, the cleaner is forced to check the amount of product in each occasion, which means that this very difficult action of unblocking the container must be carried out each time, whether or not product replenishment is required, resulting in a very inefficient and cumbersome system for these workers.

It is therefore necessary to find a way to solve this problem by allowing the container to be unlocked from the support in a way that is not so cumbersome for users and to find a way to avoid having to open the dispenser when there is sufficient product.

SUMMARY

The product dispenser in gel or cream form presented herein comprises:

- a removable container for product containment, fitted with a window allowing the interior of the container to be viewed;
- a support for the container that can be fixed to a wall; and
- means of temporarily coupling the container to the support for removal and refilling, which include a first locking mechanism to prevent the container from being removed from the support.

A second locking mechanism prevents the window from being viewed, without the need for physical separation between the container and the bracket.

Furthermore, the dispenser comprises a release device for the first and/or second locking mechanism.

The proposed gel or cream dispenser is a significant improvement on the state of the art.

This is because it provides a dispenser with temporary coupling means that allow the container to be completely removed from the support, thus facilitating the work of the cleaner and allowing the container to be placed in a safe position for refilling.

In addition, these temporary means of attachment also have the first locking mechanism that prevents removal of the container by a third party, making them secure against any attempt at theft.

On the other hand, they have the container window and covering means that allow the cleaner to observe whether it is really necessary to perform the unlocking action to carry out the refilling or on the contrary he can save himself this task as well as the time he would have invested in it, resulting in a much more efficient system for the worker.

In addition, to prevent anyone from accessing this window, it is concealed, and the dispenser has a locking mechanism that prevents the container from turning from this position.

A significant advantage of this dispenser is that it has a release device for the first locking means and a release device for the second locking means which can be operated jointly or independently, as required at any given time. This release device is very simple to use and very practical, as it does not require any complicated fitting or coupling of any element through slots or holes in the dispenser, but is a mechanism which, by means of magnets and the attraction between them, makes it possible to release the locking means or keep them locked.

This greatly facilitates the work of the cleaners as it is a release device that acts from the outside of the device and is therefore quick and easy to use.

It is therefore a very practical and efficient dispenser, which facilitates the work of the cleaners, avoiding unnecessary actions and allowing for easier use in cases where a product refill is required.

BRIEF DESCRIPTION OF THE DRAWINGS

In order to assist in a better understanding of the features of the invention, in accordance with a preferred example of a practical embodiment thereof, a series of drawings is provided as an integral part of this description, in which the following is shown for illustrative and non-limiting purposes:

FIGS. 3.1 and 3.2 show views of the support with the swivelling part of the first locking mechanism in an interposed and withdrawn position, respectively, from the first slide channel.

FIGS. 4.1 and 4.2 show views of the support with the swivelling part of the second locking mechanism in an interposed and withdrawn position, respectively, from the second slide channel.

DETAILED DESCRIPTION

A detailed description of an example of a preferred embodiment of the subject matter of the present invention is given below with the aid of the figures referred to above.

Figure 1:
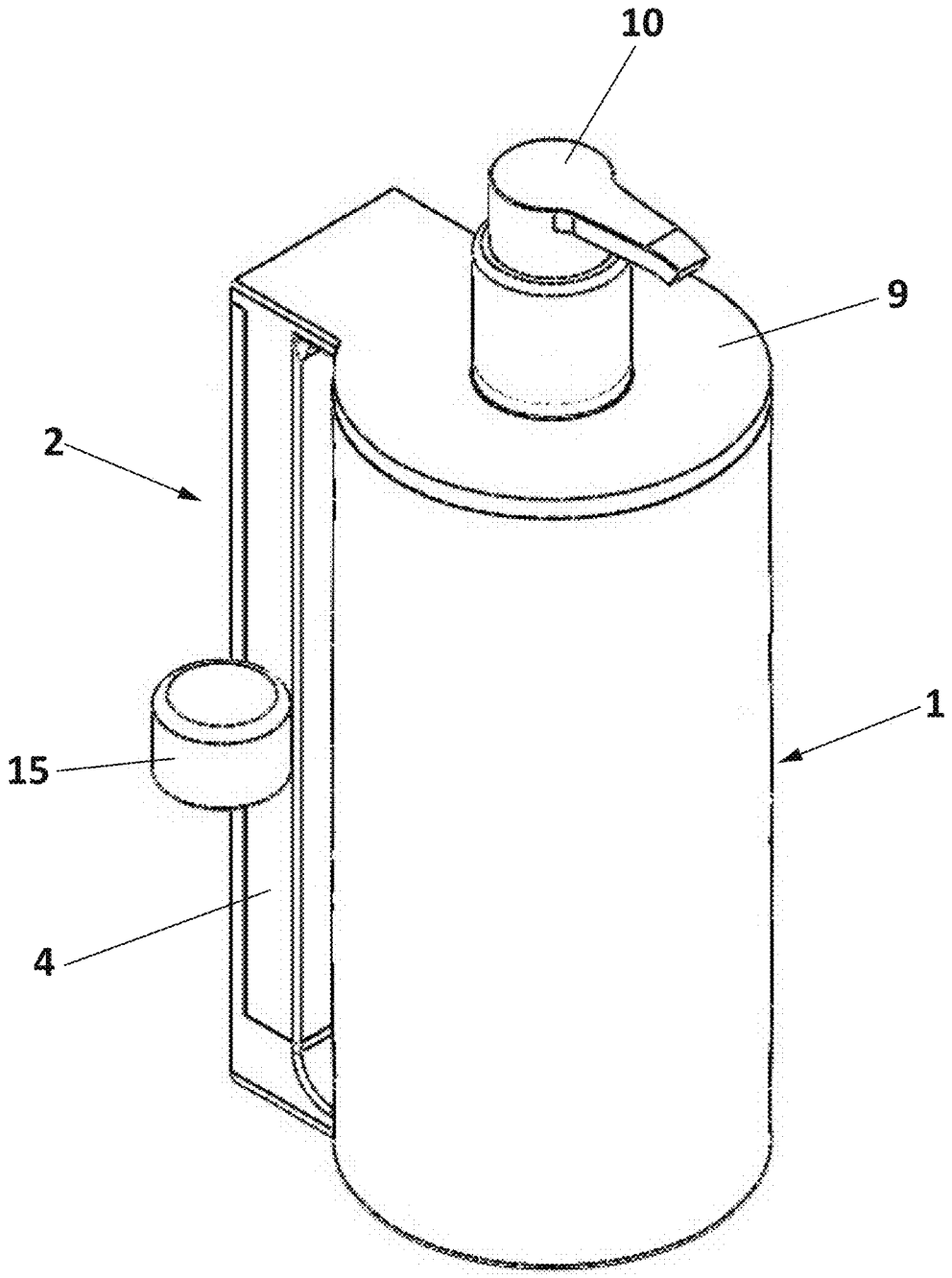
FIG. 1 shows a perspective view of the product dispenser in gel or cream form according to a preferred embodiment of the invention.
Figure 2:
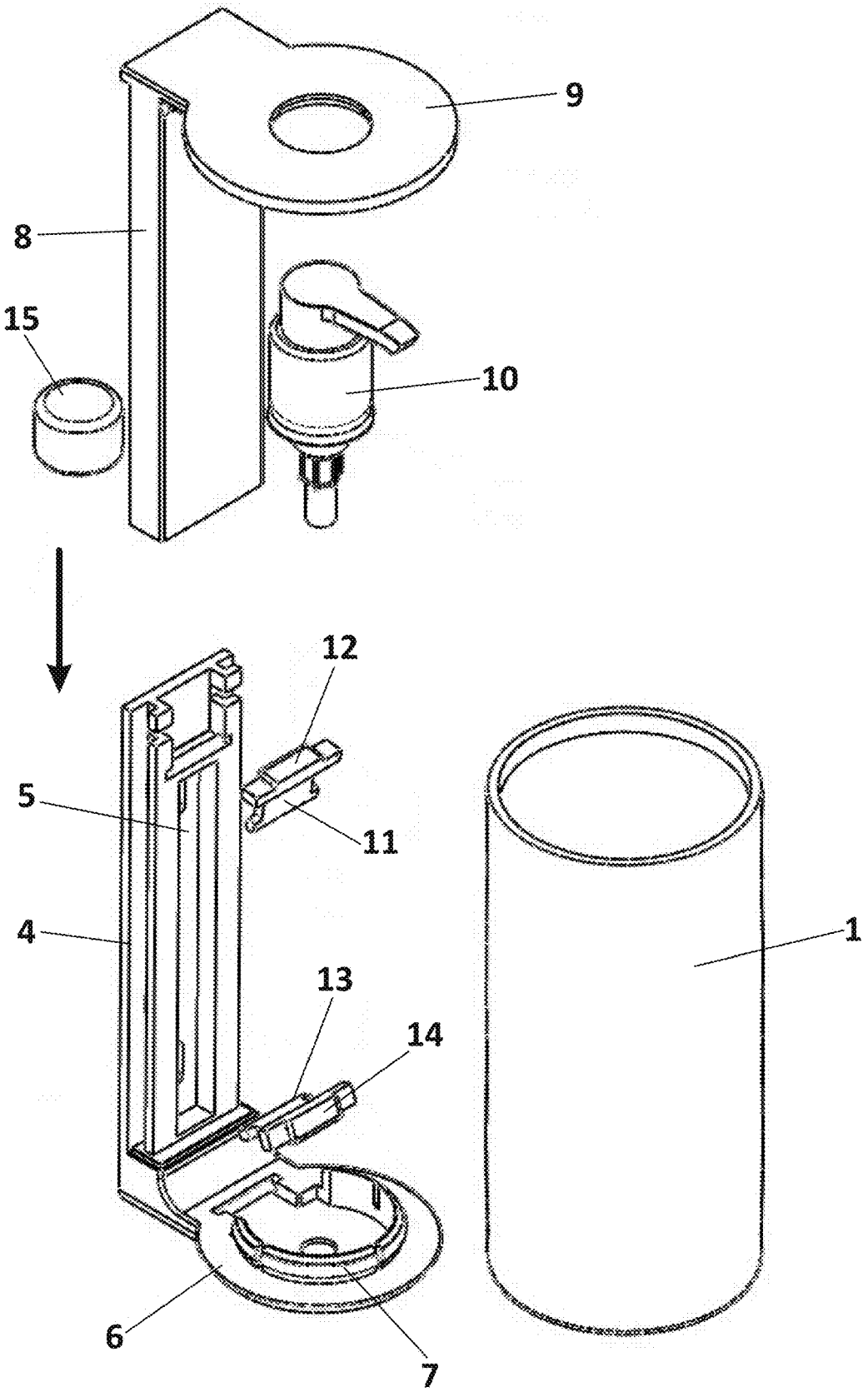
FIG. 2 shows an exploded view of the dispenser of FIG. 1.
Figure 5:
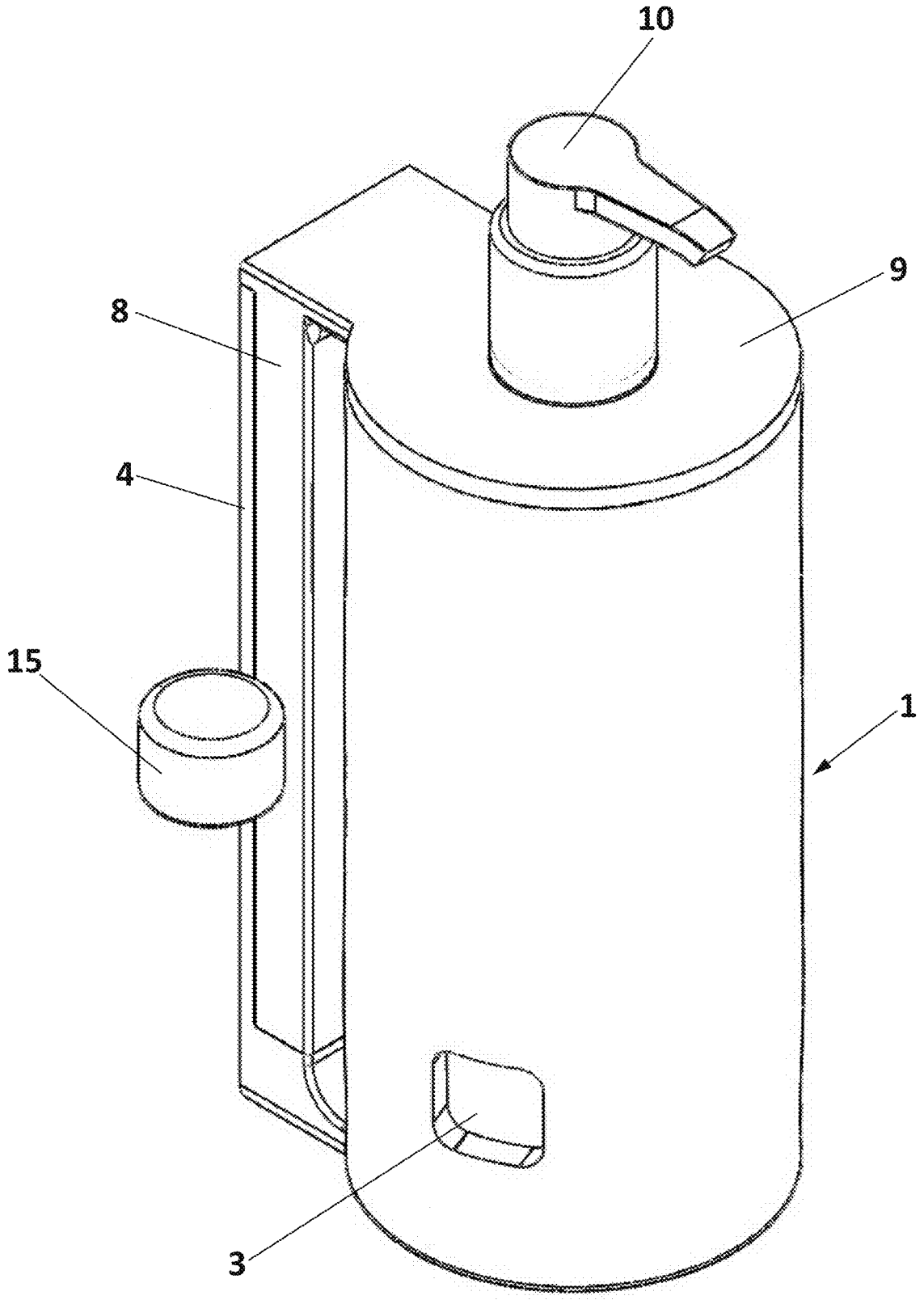
FIG. 5 shows a view in a position with the window not hidden.

The product dispenser in gel or cream form, shown in FIGS. 1 and 2, comprises a container (1) for housing the product, a support (2) for the container (1), which can be fixed to a wall, and means of temporary coupling between the container (1) and the support (2). The container (1) also has a window (3) that allows the interior of the container (1) to be viewed. This container (1) has a configuration such that, once coupled to the support (2) and ready for use, the window (3) faces the support (2) and is invisible from the outside.

The means of temporary coupling between the container (1) and the support (2) include a first locking mechanism that prevents the container (1) from being removed from the support (2). In addition, a second mechanism prevents the window (3) from being viewed, without the need for physical separation between the container (1) and the support (2).

In addition, the dispenser comprises a release device for the locking mechanisms.

In this preferred embodiment of the invention, as shown in FIG. 2, the support (2) consists of a vertical plate (4), which can be fixed to the wall and has a first linear sliding channel (5), defined on an external face of the plate (4), and a lower arm (6), which projects perpendicularly from a lower end of the plate (4) and on which a lower base of the container (1) rests. The lower arm (6) has a second circular channel (7), for coupling with the base of the container (1), so that the container (1) can be rotated with respect to the support (2).

The means of temporary coupling between the container (1) and the support (2) consist in this preferred embodiment of an elongated piece (8), which can be slid into the first channel (5), from the upper end of which an annular piece (9) extends. The annular piece (9) is intended to cover and close an open upper base of the container (1), so that a dosing valve (10) can be inserted through the central hole of the annular piece (9) to extract the product from the inside of the container (1).

The first locking mechanism consists of a first tilting flange (11), equipped with a first magnetic element (12). The first flange (11) is attachable to the first linear channel (5) for locking and immobilising the elongated piece (8) of the temporary coupling means inside the first channel (5), thus preventing its manipulation and removal.

The second locking mechanism consists of a second tilting flange (13), equipped with a second magnetic element (14). The second flange (13) can be inserted into the second channel (7) to prevent the container (1) from rotating with respect to the lower arm (6) of the support (2), thus concealing the window (3) from view.

The release device comprises a third magnetic element (15) which interacts with the first magnetic element (12) and/or the second magnetic element (14) to allow the first flange (11) and/or the second flange (13) to be tilted and released. In this way, the flange in question tilts to move to an unlocked position in which either the removal of the elongated piece (8) from the temporary coupling means or the turning of the container (1) in the second channel (7) for viewing the window (3) is permitted.

This withdrawn position of the flange is shown in FIG. 3.2 for the first locking mechanism and in FIG. 4.2 for the second locking mechanism.

To assemble the dispenser, the first step is to slide the elongated piece (8) of the coupling means inside the first channel (5) and insert the first flange (11) of the first locking mechanism. Subsequently, the base of the container (1) is fitted into the second channel (7) and the second flange (13) is inserted, so that the container (1) is positioned and immobilised with the window (3) facing the support (2), hidden from view, as shown in FIG. 1.

For disassembly, the third magnetic element (13) of the release device interacts with the first magnetic element (12) and/or the second magnetic element (14), swinging their respective tabs (11,13) to release the container (1) with respect to the first channel (5) and/or the second channel (7).

The invention claimed is:

1. Product dispenser in gel or cream form comprising:

a container for housing the product, which has a window for viewing its interior;

a support for the container, further comprising:

a vertical plate, attachable to a wall and provided with a first linear sliding channel, and a lower arm, projecting perpendicularly from a lower end of the vertical plate, provided with a second circular channel, for coupling with the base of the container;

a temporary coupling between the container and the support, comprising an elongated piece, which can be slid into the first linear sliding channel, and an annular piece extending from an upper end of the elongated piece;

wherein the container is configured so that the window faces the support and is invisible from the outside;

the dispenser being characterised in that it further comprises:

a first locking mechanism, comprising a first tilting flange, fitted with a first magnetic element, which can be fitted in the first linear sliding channel to immobilise the elongated piece inside the said first channel;

a second locking mechanism comprising a second tilting flange, equipped with a second magnetic element, attachable to the second circular channel to prevent the container from rotating relative to the lower arm of the support; and a locking mechanism release device comprising a third magnetic element which interacts with the first magnetic element and/or the second magnetic element to enable the first tilting flange and/or the second tilting flange to be tilted and released.

2. Product dispenser according to claim 1 wherein the first magnetic element, the second magnetic element and the third magnetic element are respective magnets.

* * * * *